United States Patent [19]

Mitchell et al.

[11] Patent Number: 4,558,470

[45] Date of Patent: Dec. 17, 1985

[54] SHOCK ATTENUATION SYSTEM

[75] Inventors: Hal D. Mitchell; Richard W. Glover; Donald R. Walker, all of Rolla, Mo.; Isadore Rosenberg, Downey, Calif.

[73] Assignee: Figgie International Inc., Richmond, Va.

[21] Appl. No.: 436,654

[22] Filed: Oct. 26, 1982

[51] Int. Cl.[4] ..... A42B 3/02

[52] U.S. Cl. ..... 2/414; 2/425

[58] Field of Search ..... 2/411, 412, 414, 413, 2/415, 420, 425, 410, 2, 6; 267/145

[56] References Cited

U.S. PATENT DOCUMENTS

| | | | |
|---|---|---|---|
| 2,150,747 | 3/1939 | Naulty | 155/179 |
| 2,179,148 | 11/1939 | Gerlofson | 155/179 |
| 3,251,076 | 5/1966 | Burke | 267/145 X |
| 3,447,163 | 6/1969 | Bothwell et al. | 2/412 |
| 3,577,562 | 5/1971 | Holt | 2/414 |
| 3,877,076 | 4/1975 | Summers et al. | 2/3 R |

FOREIGN PATENT DOCUMENTS

| | | | |
|---|---|---|---|
| 0267325 | 5/1912 | Fed. Rep. of Germany | 2/20 |
| 0704725 | 2/1931 | France | 2/411 |
| 1578351 | 11/1980 | United Kingdom | 2/412 |

*Primary Examiner*—Peter Nerbun

*Attorney, Agent, or Firm*—Senniger, Powers, Leavitt and Roedel

[57] ABSTRACT

A shock attenuation system useful in protective headgear is disclosed wherein shock is attenuated by the axial compression and lateral deflection of elastomeric columns. Cushioning material occupies the spaces between the columns.

12 Claims, 13 Drawing Figures

SHOCK ATTENUATION SYSTEM

BACKGROUND OF THE INVENTION

The present invention relates generally to a shock attenuation system useful in protective headgear, running shoes and other shock-attenuating applications, and more particularly to such a system wherein shock attenuation is accomplished by the resilient deformation of elastomeric columns.

This invention represents an improvement on the shock attenuation system disclosed in pending co-assigned application Ser. No. 185,208 now abandoned. As described therein, the system comprises a liner secured to the inside surface of an outer protective shell which is worn on the head. The liner includes a series of tubes of elastomeric material disposed in generally parallel side-by-side relation with their central axes generally parallel to the inside surface of the shell. The tubes are elastically deformable in the radial direction and sufficiently closely spaced that when one deforms, as when a blow is delivered to the outer shell, it is engageable with the sides of adjacent tubes for deforming them thereby to attenuate the shock felt by the person wearing the headgear.

U.S. Pat. Nos. 3,877,076, 2,150,747, and 2,179,148 show various types of shock attenuation apparatus generally in the field of this invention.

SUMMARY OF THE INVENTION

Among the several objects of this invention may be noted the provision of an improved shock attenuation system wherein shock is attenuated by the axial compression and lateral deflection of elastomeric columns; the provision of such a system which provides a higher level of shock attenuation than prior systems; the provision of such a system which continues to provide an adequate level of shock attenuation after numerous impact loadings; the provision of such a system which may be releasably secured to the outer shell of protective headgear, for example, for enabling ready removal of the system from the shell, as for inspection and replacement, if necessary; the provision of such a system which is relatively compact and lightweight; and the provision of such a system which is relatively economical to manufacture.

Generally a shock attenuation system of the present invention comprises a plurality of shock attenuating columns adapted to be mounted for axial loading of the columns during impact. The columns are of a substantially resilient elastomeric material and are so dimensioned and configured that, when subjected to an axial impact force of predetermined magnitude, they are adapted resiliently to deform for attenuating the shock resulting from said impact force, the columns then being adapted to spring back substantially to their undeformed shape.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
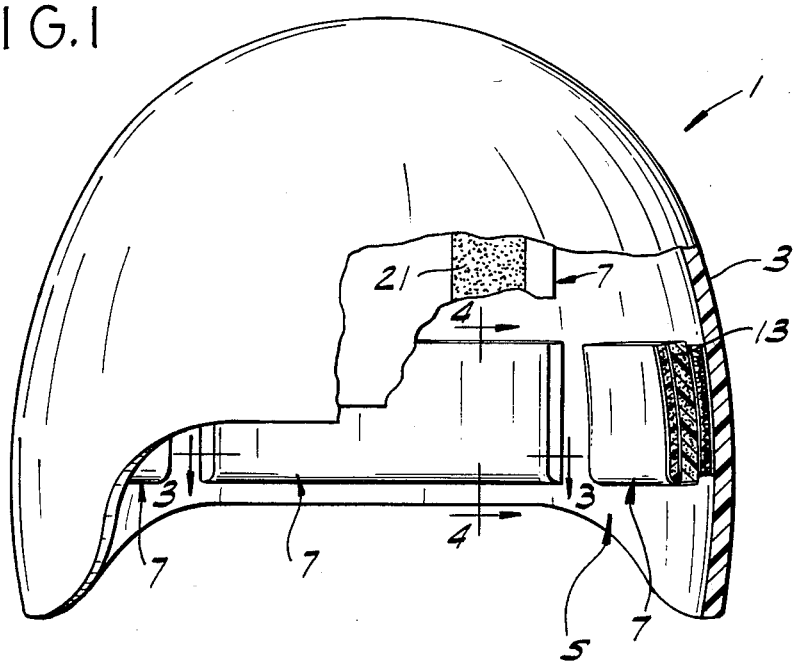
FIG. 1 is a front view of a helmet having a shock attenuation system of the present invention, portions of the helmet being broken away for purposes of illustration.
Figure 2:
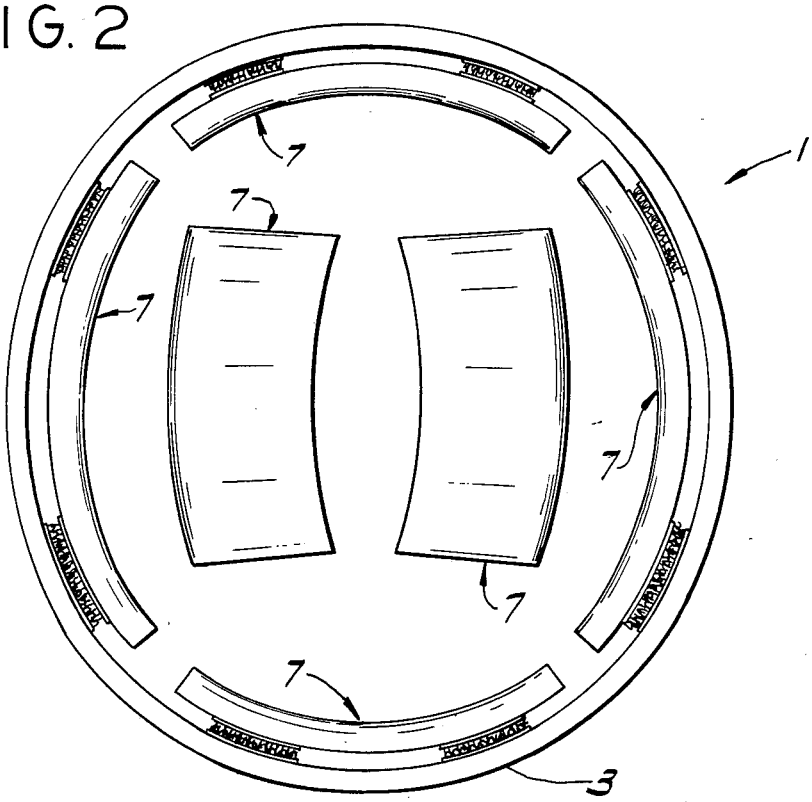
FIG. 2 is a bottom view of the helmet shown in FIG. 1.

Referring now to the drawings, and first more particularly to FIGS. 1 and 2, there is generally indicated at 1 protective apparatus in the form of headgear (an aviation helmet as shown) comprising an outer impact-receiving member or shell 3, which may be of a suitable substantially rigid material, such as resin-impregnated fiberglass, having a relatively high impact resistance. A shock attenuation system of this invention, generally designated S, is provided on the inside of the shell for attenuating the shock on the head resulting from an impact (or impacts) on the shell. While the use of system S in protective headgear is considered to be an important application of the present invention, it is by no means limited to this application. Thus the present system as herein described may be used to protect other parts of the body. In fact, the system may be adapted for virtually any application involving shock attenuation.

As incorporated in the headgear shown in the drawings, the shock attenuation system S comprises a plurality of separate pads 7 constituting secured to the interior surface of the shell 3 at positions corresponding to the front (forehead), back, sides and top of the head. As shown best in FIGS. 3 and 4, each pad contains a plurality of spaced-apart shock attenuating columns 9 arrayed in a plurality of generally parallel rows (four rows of seven columns each as shown). The spacing S1 between adjacent columns in a row is substantially equal, as is the spacing S2 between adjacent rows of columns. Each column is hollow and tubular in shape and formed of a substantially resilient elastomeric material, such as vinyl, urethane, or polyethylene. All of the columns in the array are of substantially uniform diameter and length and have square-cut end faces, i.e., the two end faces of each column lie in planes generally perpendicular to the central axis of the column.

Each pad is of layered construction, comprising a first or inner layer 11 of a suitable fabric, for example, adjacent the interior surface of the shell 3, a relatively thick second layer 13 of cushioning material, such as a vinyl nitrile foam of the type sold under the trade designation "326 Rubatex" by Rubatex Corporation of Bedford, Va., a third layer 15 identical to the first layer, a fourth layer 17 of the same cushioning material as the second layer but not as thick, and a fifth or outer layer 19 of a suitable facing material such as leather. The columns 9 extend between the first and third layers 11, 15 through the cushioning layer 13. The cushioning material of layer 13 occupies the spaces between the columns (the interiors of which are open) and is of substantially the same thickness as the columns. The columns are secured at their ends by a suitable adhesive, for example, to the first and third layers 11, 15, which may be referred to as carrier sheets. The central axes of the columns extend generally perpendicular to these sheets 11, 15. The carrier sheets 11, 15 and cushioning layer 13 combine to constitute means for supporting the columns in the aforesaid array. Other means for so supporting the columns may also be suitable. In this regard, it is contemplated that the columns 9 and carrier sheets 11, 15 may be integrally formed (e.g., molded).

Each pad 7 is removably mounted on the inside of shell 3 with the central axes of the columns extending generally at right angles to the interior surface of the shell (thereby ensuring axial loading of the columns when the helmet is subjected to an impact) by fastening means comprising a pair of two-part fasteners, one part, in the form of a patch 21, of each pair being secured (e.g., glued) to the inside face of the inner carrier sheet 11 of the pad, and the other part, in the form of a patch 23, of each pair being secured (e.g., glued) to the interior surface of the rigid shell 3. The two patches 21, 23 of each pair are preferably formed from a fabric fastening material available commercially under the trademark VELCRO, such as shown in Mestral U.S. Pat. No. 2,717,431, issued Sept. 13, 1955. Thus the patches have cooperable fastening elements thereon which are interengageable for fastening the pad to the shell, and disengageable for removal of the pad from the shell (as for inspection and replacement, if necessary). It will be understood that additional VELCRO patches 23, or even continuous VELCRO strips may be placed around the interior surface of the shell so that the position of the pads may be adjusted to fit the head of the particular person wearing the headgear. Other means for fastening the pads 7 to the helmet may also be used.

In accordance with this invention, the pads are designed to attenuate the shock on the head of the wearer resulting from an impact on the shell. It will be noted in this regard that the columns 9 are disposed for axial loading during impact and are so dimensioned and configured that, when subjected to an axial impact force of predetermined magnitude, they are adapted resiliently to deform for attenuating the shock resulting from the force of impact. During the initial stages of such deformation, the columns are believed to compress axially, that is, their effective length as measured in the direction perpendicular to the carrier sheets 11, 15 decreases. This decrease is believed to be effected by a bending of the column walls without a substantial increase in the density of the wall material, although it is possible that some actual increase in wall density may occur. During the latter stages of the deformation process, the walls of the tubular columns deflect laterally or buckle under the force of impact. This buckling is in random and irregular fashion, as illustrated in FIG. 4A, and usually begins with a local crippling at some part of each column. After the impact force has dissipated, the columns are then adapted resiliently to return substantially to their undeformed (FIG. 4) shape. Thus, unlike many of the prior art shock attenuation systems, this system of the present invention is designed for repeated use.

Another important advantage of this invention is that, given a set of design parameters (e.g., weight, overall thickness, etc.), the system S may be engineered to meet virtually any performance requirement over a wide range of requirements. This is accomplished by varying the physical properties and characteristics of the columns 9, such as the material out of which they are made, their length to diameter (slenderness) ratio, the angle at which their ends are cut, and their proximity to one another. The effect of each of these factors on the ability of the system to attenuate shock is clearly demonstrated in the graphs of FIGS. 5–8.

Each of these graphs depicts the results of a series of tests in which a test head form weighing eleven (11) lbs. (5.0 kg.) and having a triaxial accelerometer at its center of gravity was dropped in guided free fall from heights of 18, 24, 36 and 48 inches (45.7, 61.0, 91.4 and 121.9 cm.) onto each of a series of pads 7 incorporating shock attenuation systems S of this invention. The pads were supported by a rigid steel anvil. The maximum deceleration of the head form was measured for each drop. The results of the test were then plotted on the graph, with the drop height being represented in inches on the X-axis and the maximum deceleration being represented in "peak G's" on the Y-axis, each G being a unit of deceleration equal to 32 ft/sec.$^2$ (9.8 m/sec.$^2$). The pads 7 used in conducting the tests were constructed in the manner described above and were identical in every respect except as noted hereinafter. Thus, unless otherwise noted, each pad tested was 5½" (14.0 cm.) long, 2½" (6.4 cm.) wide and ¾" (1.3 cm.) thick, and the columns 9 in each pad were tubular in shape with square-cut end faces, of 80-durometer (Shore A) urethane, and arrayed in four rows of seven columns each, with the spacing S1 between adjacent columns in each row being approximately ¾" (1.9 cm.), and the spacing S2 between adjacent rows being approximately ⅝" (1.6 cm.). Each column had, unless otherwise noted, an outside diameter of about ½" (1.3 cm.), an inside diameter of about 7/16" (1.1 cm.), and a length of about ½" (1.3 cm.).

Figure 5:
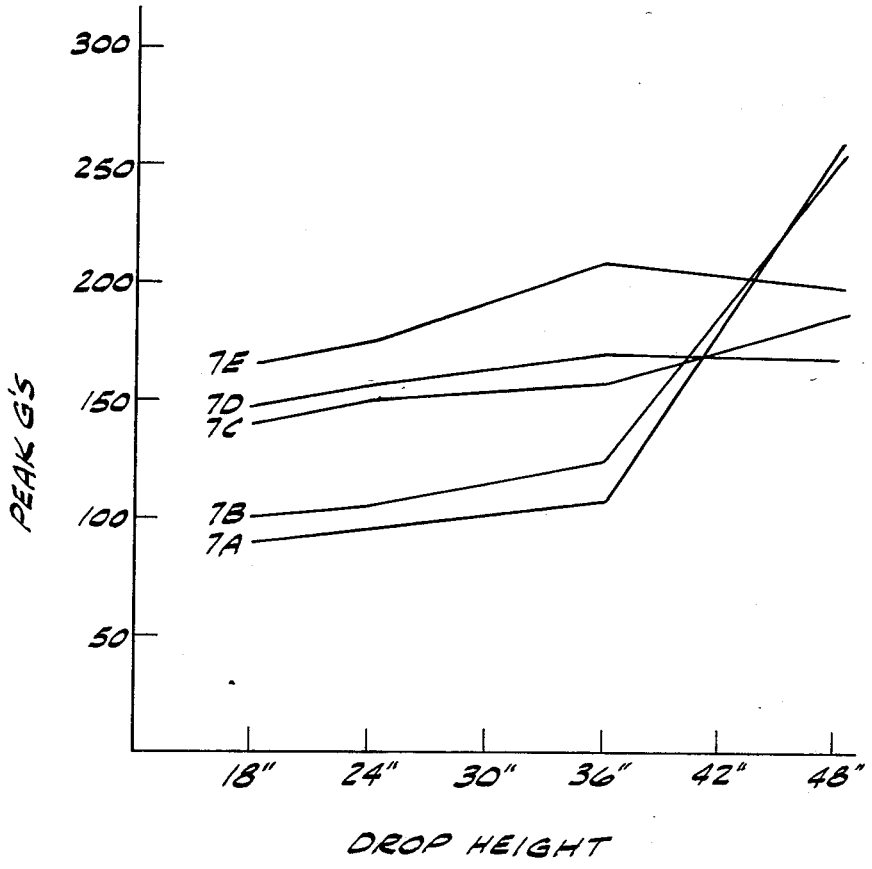
FIGS. 5–8 are graphs showing the results of a series of tests conducted on shock attenuation systems of this invention.

The graph of FIG. 5 illustrates the effect of the material out of which a column 9 is made on the ability of the system S to attenuate shock. In obtaining the data for this graph, five different pads, designated 7A–E, were tested in the manner described above. These pads were identical except for the material out of which the columns 9 were made. In this regard, the columns of pads 7A–7E were constructed out of the following materials:

| Pad | Material | Hardness (Shore A durometer) |
|---|---|---|
| 7A | Vinyl | 30 |
| 7B | Urethane | 40 |
| 7C | Polyethylene | 90 |
| 7D | Ethylene Vinyl Acetate | 90 |
| 7E | Urethane | 80 |

It will be observed from the graph that pads 7A and 7B with columns 9 of lower durometer material were generally more effective (i.e., obtained lower "peak G" results) at lower drop heights (less than about 40" or 101.6 cm.) where the impact energy involved was correspondingly lower, and that pads 7C–7E with columns of higher durometer material were generally more effective at greater drop heights (more than about 40" or 101.6 cm.) where the impact energy was higher.

Figure 6:
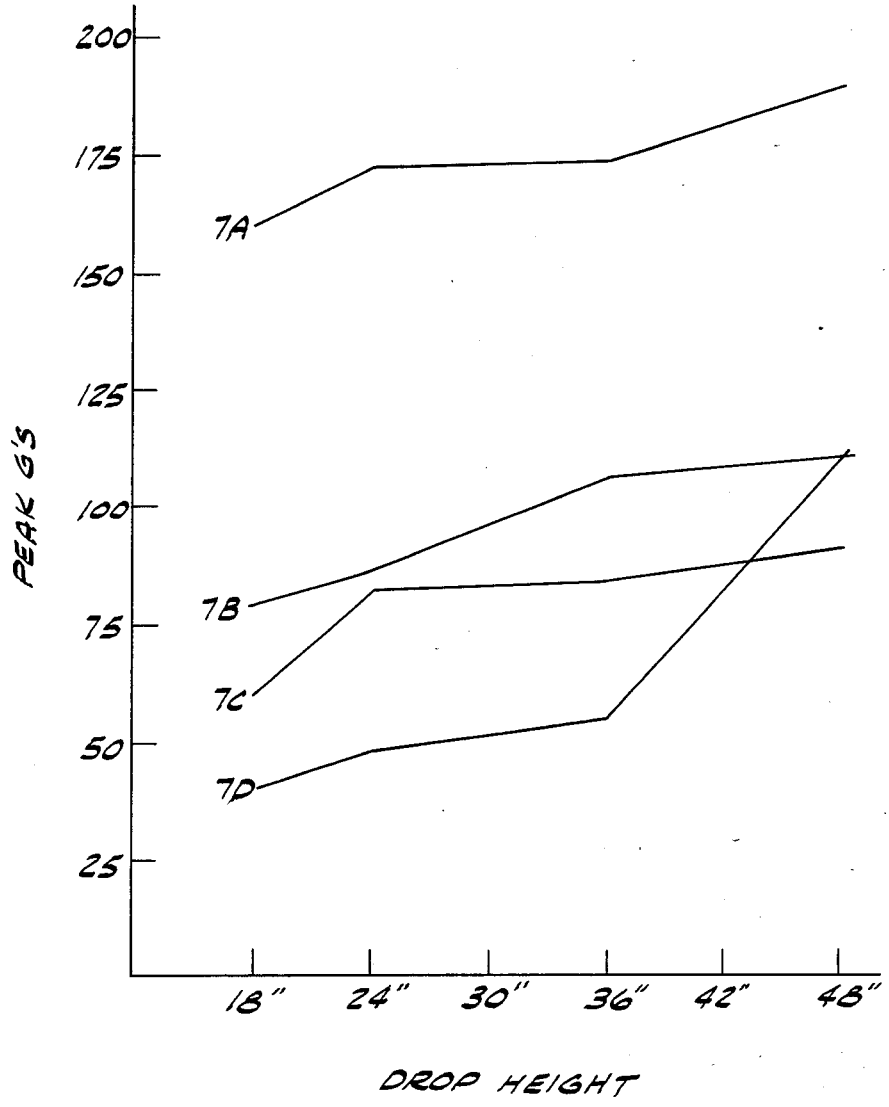

The graph of FIG. 6 illustrates the effect that the column slenderness ratio (the ratio of the length of a column 9 to its diameter) has on the ability of the system to absorb energy. In obtaining the data for this graph, four pads, designated 7A–7D, were tested. The pads were identical except that the length (and thus the slenderness ratio) of the columns 9 varied from pad to pad as follows:

| Pad | Column Length | Slenderness Ratio |
|---|---|---|
| 7A | 0.50" (1.3 cm.) | 1.0 |
| 7B | 0.75" (1.9 cm.) | 1.5 |
| 7C | 1.0" (2.5 cm.) | 2.0 |
| 7D | 1.25" (3.2 cm.) | 2.5 |

The test results depicted in the graph of FIG. 6 indicate that as the column slenderness ratio increases within the range of 1.0–2.5, the effectiveness of the system in attenuating shock also increases. There is some indication, however, that as the column slenderness ratio approaches 2.5, the ability of the system to attenuate higher impact energies (corresponding to a test drop height of greater than about 40" or 101.6 cm.) decreases. It is preferred that the slenderness ratio not exceed 3.0.

Figure 7:
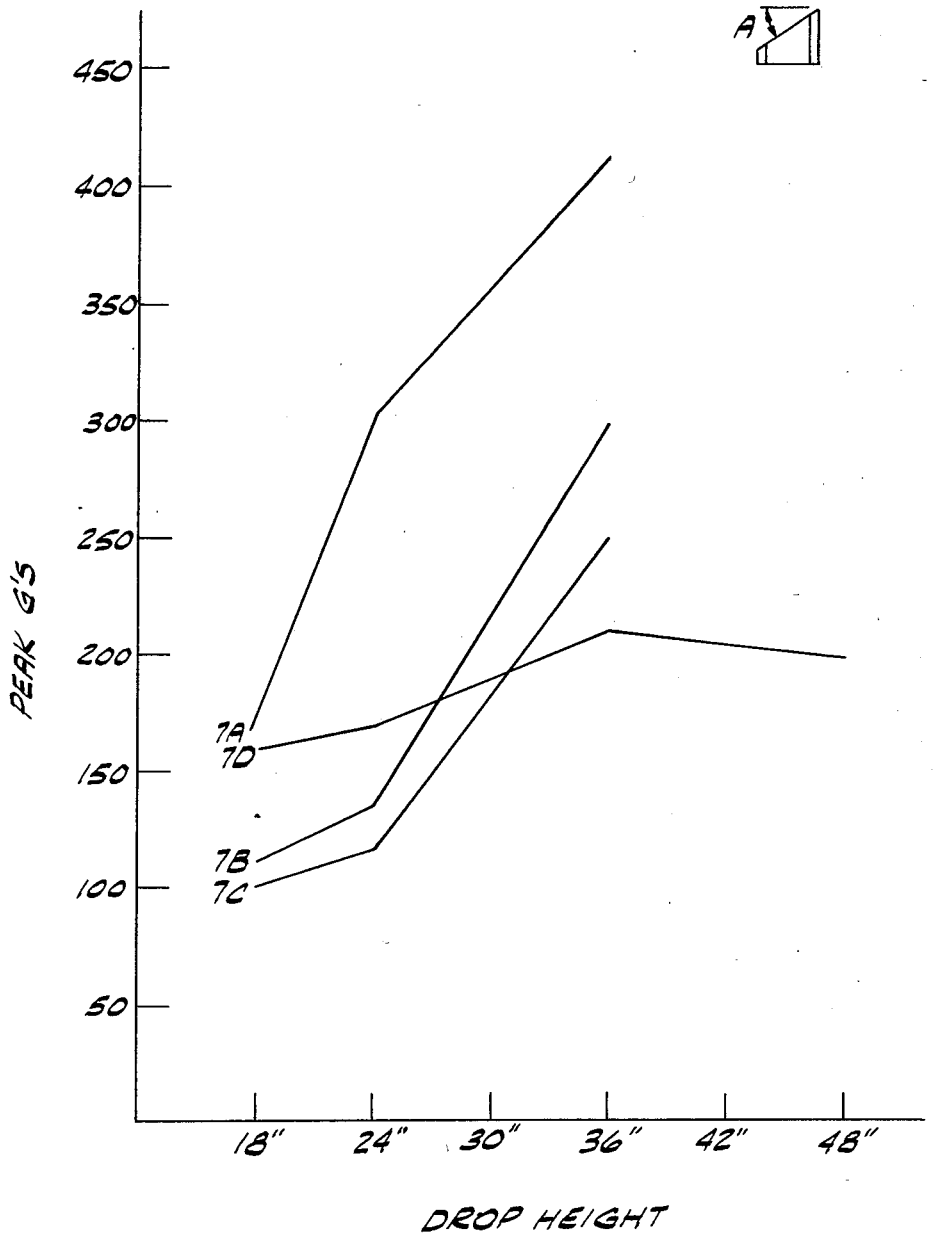

The graph of FIG. 7 illustrates the effect of the angle at which the end faces of columns 9 are cut on the shock attenuation properties of a system S. Again, four pads were used in this test, these being designated 7A–7D. The pads were identical except that the angle (designated A in FIG. 7) at which the column end faces in each pad were cut differed from pad to pad as follows:

| Pad | Angle of Cut |
|---|---|
| 7A | 37° |
| 7B | 26° |
| 7C | 14° |
| 7D | 0° (square cut) |

It will be observed from the graph that pads 7B and 7C containing columns having angle cuts of 26° and 14°, respectively, were the most effective at lower drop heights (less than about 30" or 76.2 cm.), and that pad 7D containing columns 9 with square-cut ends was the most effective at higher drop heights (greater than about 30" or 76.2 cm.). This suggests that columns with end faces cut at a relatively shallow angle may be the most effective in applications involving low impact forces, while square-cut columns may be the most effective for applications in which high impact forces are involved.

Figure 8:
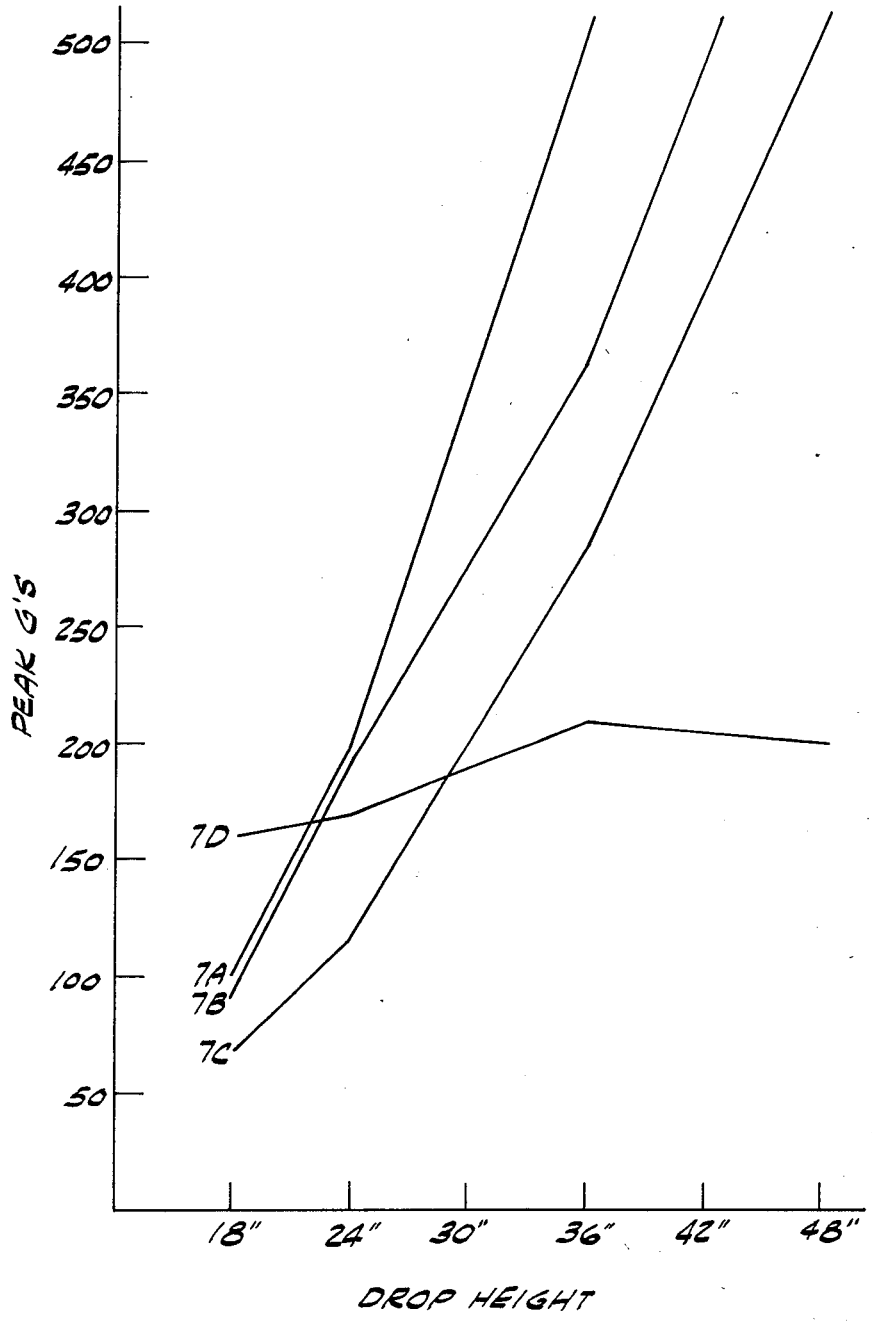

The graph of FIG. 8 illustrates the effect of column proximity on the shock attenuation characteristics of a system S. Four pads, designated 7A–7D, were used in obtaining the test data for this graph. The pads were identical except that the number of columns per pad varied from pad to pad. Thus, pads 7A–7D contained 11, 14, 20 and 28 columns, respectively arrayed as shown in FIGS. 9A–9D, respectively. It will be observed from the FIG. 8 graph that pads 7A–7C were generally the most effective at lower drop heights, and that pad 7D was the more effective at higher drop heights (more than about 28" or 71.1 cm.). This indicates that systems wherein the columns are spaced relatively far apart (as in pads 7A–7C) may be more effective for attenuating shock in applications involving relatively small impact forces, and that systems wherein the columns are relatively closely spaced (as in pad 7D) may be more effective in applications wherein greater impact forces are involved.

It will be observed from the above that a shock attenuation system S of the present invention may be designed to meet virtually any performance requirement within a wide range of requirements simply by varying the physical properties and characteristics of the columns 9. Thus, for applications involving relatively low impact energies, it may be desirable to use a system wherein the columns are of low durometer (e.g., 30–40 on the Shore A scale) material and 1–¼" (2.5–3.2 cm.) long with end faces cut at an angle of 14°. Moreover, the columns need not be relatively closely spaced. On the other hand, for applications involving relatively high impact energies, it may be appropriate to use a system wherein the columns are of high-durometer (e.g., 80–90 on the Shore A scale) material and about 1" (2.5 cm.) long with square-cut end faces. In such applications it is also preferable to have the columns more closely spaced in a relatively high-density formation.

While the columns 9 shown in the drawings are in the shape of round columns, it will be understood that they may take other forms. For example, the tubes may be of solid construction and have any suitable cross-sectional configuration (triangular, rectangular, elliptical, etc.)

The results of comparative tests clearly reveal the superiority of the shock attenuation system S of the present invention over prior systems. In the comparative tests conducted, a test form weighing twelve (12) lbs. (5.5 kg.) and having a triaxial accelerometer at its center of gravity was dropped in guided free fall from a height of sixty (60) inches (152.4 cm.) onto the system being tested, which was supported on a rigid steel anvil covered by a layer of high-durometer polyurethane. The maximum deceleration of the head form was measured for each drop. Three systems designated A, B and C were tested. The overall thicknes of each system was 1" (2.5 cm.).

Figure 3:
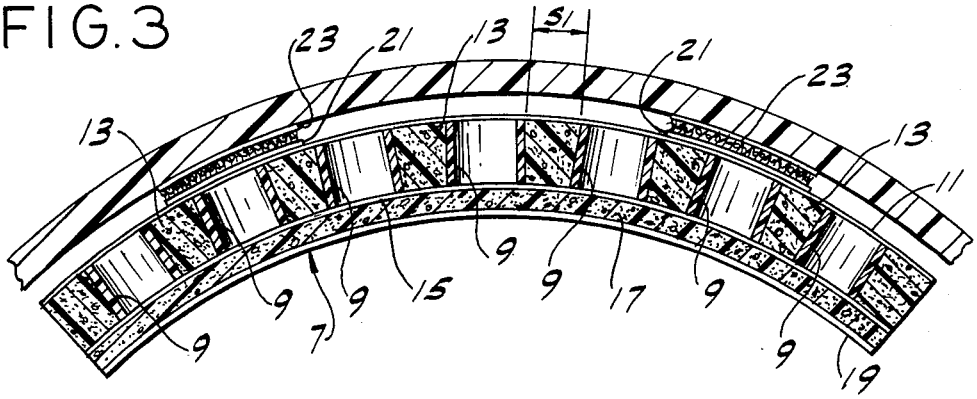
FIG. 3 is an enlarged horizontal section on line 3—3 of FIG. 1 showing the construction of a pad made in accordance with this invention.
Figure 4:
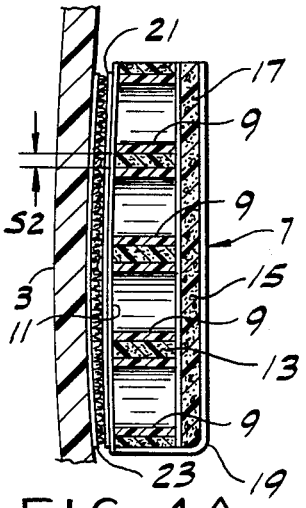
FIG. 4 is an enlarged vertical section on line 4—4 of FIG. 1.
Figure 4A:
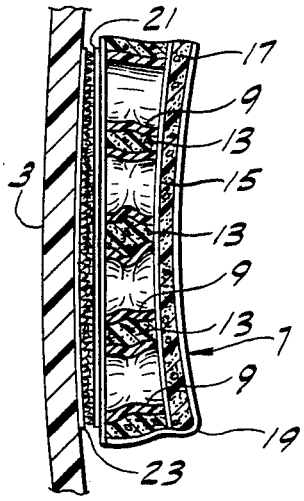
FIG. 4A is a view similar to FIG. 4 showing the operation of the system when subjected to an impact force.
Figure 9A:
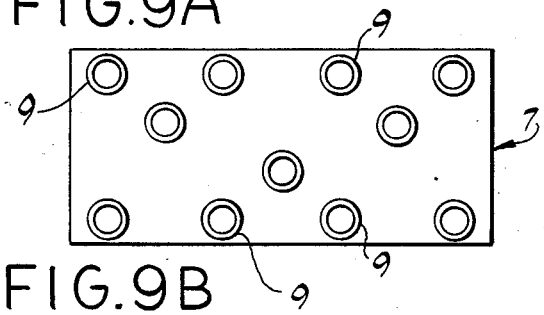
FIGS. 9A–9D are diagrammatic views illustrating possible ways in which shock-attenuating columns of the present invention may be arranged.
Figure 9B:
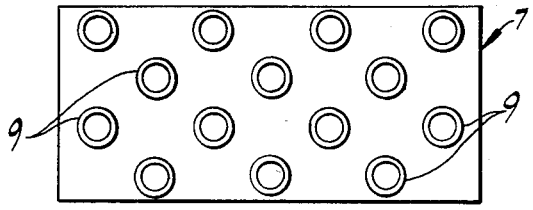
Figure 9C:
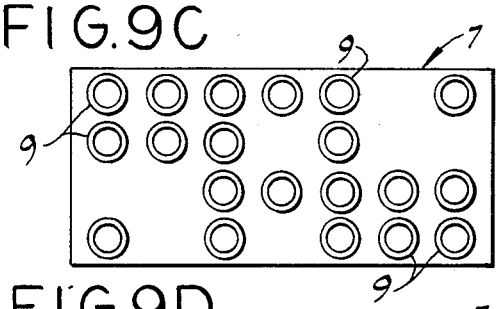
Figure 9D:
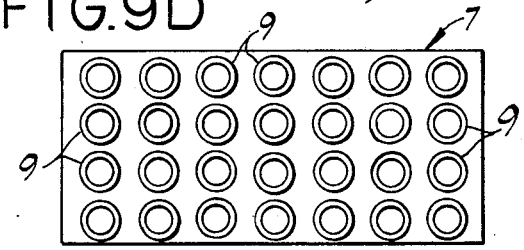

System A was constructed in accordance with the present invention and comprised a pad of the same construction as the one shown in FIGS. 3 and 4. Thus, the columns 9 in each pad were tubular in shape with square-cut end faces, of 80-durometer (Shore A) urethane, and arrayed in four rows of seven columns each, with the spacing S1 between adjacent columns in each row being approximately ¾" (1.9 cm.), and the spacing S2 between adjacent rows being approximately ⅝" (1.6 cm.). Each column had an outside diameter of about ½" (1.3 cm.), an inside diameter of about 7/16" (1.1 cm.) and a length of about ½" (1.3 cm.).

System B was of the type shown in coassigned pending U.S. application Ser. No. 185,208, comprising a series of horizontal tubes disposed in generally parallel side-by-side relation with their axes generally perpendicular to the direction of impact force (i.e., generally parallel to the top horizontal surface of the anvil). The tubes were of elastically deformable (80-durometer polyurethane) material and sufficiently closely spaced that when one deformed during impact it engaged the sides of adjacent tubes for deforming them thereby to attenuate the shock. The tubes used had inside and outside diameters of about 7/16" (1.1 cm.) and ½" (1.3 cm.), respectively, and were covered by a ½" (1.3 cm.)-thick layer of vinyl nitrile foam of the type sold under the trade designation "326 Rubatex" by Rubatex Corporation of Bedford, Va., the overall thickness of the system thus being 1" or 2.5 cm. (½" of tubing and ½" of "Rubatex" foam material).

System C was constituted by a flat sheet of 1" (2.5 cm.)-thick polyurethane foam of the type sold under the trade designation "Poron" by Rogers Company of Rogers, Conn.

Table 1 hereinbelow specifies the maximum deceleration (in "peak G's") experienced by the test form as it was dropped on Systems A–C.

TABLE 1

| System | G's |
|---|---|
| A | 90 |
| B | 166 |
| C | 158 |

It will be observed from these readings that, of the three systems, system A is by far the most effective for attenuating shock. Indeed, the 90-G figure achieved by system A approaches the theoretical minimum of 60 peak G's for a stopping distance of 1.0" (2.5 cm.). This 60-G figure is arrived at by assuming that the kinetic energy absorbed by a system equals the work done by the system. Assuming this to be the case, the following conclusions can be drawn $$\tfrac{1}{2}mV^2(\text{kinetic energy}) = mAd\ (\text{work})$$

or $$A = V^2/2d$$

where "A" equals the theoretical deceleration experienced by the head form, "m" equals the mass of the head form, "V" equals the velocity of the head form at the time of impact, and "d" equals the maximum allowable stopping distance. The velocity of the head form at the time of impact ("V") is equal to $\sqrt{2ax}$, where "a" equals 32 ft/sec.$^2$ (9.8 m/sec$^2$) and "X" equals the drop height (60 inches or 1.52 m.) of the helmet. Using this formula, "V" equals 17.9 ft/sec. (5.46 m/sec.). Given a stopping distance ("d") of 1.0 inch (0.025 m.), the theoretical deceleration ("A") equals 1928 ft/sec.$^2$ (587.7 m/sec.$^2$) or approximately 60 G's. Thus under the test conditions described above, system A of the present invention was 66 percent as efficient as the "ideal" system; system B was 36 percent as efficient; and system C was 38 percent as efficient.

Additional tests conducted on a helmet with a shock attenuation system of the present invention also establish that the helmet retains its shock-attenuating capabilities even after repeated impacts. These tests were conducted in accordance with the ANSI Z90.1 (1973) test method recognized by the Department of Transportation for use in testing motor vehicle helmets. Pursuant to the test method, a helmet having a shock attenuation system S of this invention is placed on a head form having a triaxial accelerometer at its center of gravity and is dropped in guided free fall from a height of 72" (182.9 cm.) onto a rigid flat anvil, or from a height of 54" (137.2 cm.) onto a hemispherical anvil. The maximum deceleration of the head form is then measured for each drop. To meet the Department of Transportation standards, the magnitude of deceleration cannot exceed 400 G's at any time. Nor can it exceed 200 G's for more than 2 milliseconds (0.002 seconds) or 150 G's for more than 4 milliseconds (0.004 seconds).

In a first series of tests, a helmet having a shell of a resin-impregnated fiberglas material was equipped with six pads 7 positioned as shown in FIGS. 1 and 2. The two crown pads measured 5¾" (14.6 cm.) long, 3½" (8.9 cm.) wide and about ¾" (1.9 cm.) thick. The front, rear and side pads measured 6¼" (15.9 cm.) long by 3¾" (9.5 cm.) wide by about ¾" (1.9 cm.) thick. The columns 9 in each pad were tubular in shape with square-cut end faces, of 80-durometer (Shore A) urethane, and arrayed in four rows of seven columns each, with the spacing S1 between adjacent columns in each row being approximately ¾" (1.9 cm.), and the spacing S2 between adjacent rows being approximately ⅝" (1.6 cm.). Each column had an outside diameter of about ½" (1.3 cm.), an inside diameter of about 7/16" (1.1 cm.), and a length of about ½" (1.3 cm.). Equipped with these pads, the helmet was dropped eleven times from a height of 72" (182.9 cm.) onto a flat rigid anvil, with two of the drops being on a side of the helmet, two on the front of the helmet, three on the rear of the helmet and four on the top of the helmet. The Department of Transportation standards were met in every instance. The same helmet was also dropped four additional times from a height of 54" (137.2 cm.) onto a rigid hemispherical anvil, with two of the drops being on a side of the helmet and two drops on the front of the helmet. The results also met the Department of Transportation standards, again demonstrating the effectiveness of the present invention to attenuate shock even after repeated impacts.

In a second series of tests, the six pads described above were replaced by six smaller pads, the two crown pads measuring 4¾" (12.1 cm.) long, 2½" (6.4 cm.) wide and ¾" (1.9 cm.) thick and the front, rear and side pads measuring 5¼" (13.3 cm.) long, 2½" (6.4 cm.) wide and ¾" (1.9 cm.) thick. The columns 9 in the pads were identical in size, shape and composition to those used in the first series of tests. The columns were arrayed in four rows of six columns each, with the spacing between adjacent columns in each row being approximately ⅝" (1.6 cm.), and the spacing S2 between adjacent rows being approximately ⅝" (1.6 cm.). Equipped with these pads, the helmet was dropped eleven times from a height of 72" (812.9 cm.) onto a flat rigid anvil, with two of the drops being on a side of the helmet, three drops on the front of the helmet, two drops on the rear of the helmet and four drops on the top of the helmet. As in the first series of tests, the standards of the Department of Transportation were met in every instance, thereby again establishing the effectiveness of the helmet in attenuating shock even after repeated impacts.

A shock attenuation system S of the present invention has particular application to protective headgear, such as aviation, racing and football helmets. Such headgear must be able to effectively attenuate the shock resulting from relatively large impact forces, and yet cannot be excessively bulky or heavy, which would unduly restrict mobility. A system may readily be designed to meet these requirements. Thus, to minimize bulk and weight, relatively short columns should be used. And to maximize the ability of the system to attenuate shock from large impact forces, the columns should be closely spaced and of a high-durometer material, such as 80-durometer urethane, with square-cut ends.

A system S of the present invention is suited for virtually any application involving shock attenuation. Thus it may be incorporated in running shoes, body armor and car bumpers, for example. Indeed, system S may be used in any situation where a person or thing is to be protected from the shock of a collision, regardless of whether that person or thing is stationary or moving during the collision. Where exceptionally large impact forces are involved, as in automobile collision applications, a series of systems S (such as pads 7) may be stacked one on another to achieve the necessary shock attenuation. The arrangement and spatial orientation of the pads 7 with respect to one another will vary from application to application depending on the circumstances.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. Protective apparatus for the body comprising:

an outer shell of substantially rigid material adapted to be worn on a part of the body to be protected such as the head;

a shock attenuation system on the inside of the shell comprising a plurality of pads adapted for engagement with the head, each pad comprising a multiplicity of spaced-apart resilient columns each constituted by a hollow integrally formed one-piece tubular member of resilient synthetic resin material haivng a slenderness ratio of less than 3.0, the slenderness ratio being the ratio of column length to column diameter, and a layer of cushioning material occupying the spaces between the columns having a thickness generally corresponding to the height of the columns, said columns being so dimensioned and configured that, when subjected to an axial impact load of predetermined magnitude, the walls of the columns are adapted resiliently to buckle in irregular and random fashion for attenuating the shock resulting from said impact load, said columns then being adapted resiliently to return substantially to their undeformed shape; and means for fastening each pad to the inside surface of the shell with said columns generally at right angles to the shell.

2. A shock attenuation system as set forth in claim 1 further comprising a relatively thin flexible carrier sheet having said columns on one face thereof extending with their axes generally at right angles to the carrier sheet, said columns and carrier sheet being integrally molded of a resilient synthetic resin material, each pad being adapted to be mounted on the inside surface of the shell with said one face of the carrier sheet facing the shell and with said layer of cushioning material disposed between the shell and the carrier sheet.

3. A shock attenuation system as set forth in claim 2 wherein said columns are relatively short and squat with a slendernes ratio of about 1.0.

4. A shock attenuation system as set forth in claim 3 wherein said columns are made of a material having a Shore A durometer in the range of 50–90.

5. A shock attenuation system as set forth in claim 1 wherein the end faces of the columns are angle-cut, lying in planes which extend obliquely with respect to the central axes of the columns.

6. A shock attenuation system as set forth in claim 1 wherein the columns are of substantially uniform diameter.

7. A shock attenuation system as set forth in claim 6 wherein said columns are arranged in an array comprising a plurality of generally parallel rows of columns, the spacing between the central axes of any two adjacent columns in a row being substantially equal.

8. Protective headgear comprising:

an outer shell of substantially rigid material adapted to be worn on the head;

a shock attenuation system on the inside of the shell comprising pad means adapted for engagement with the head, said pad means comprising a relatively thin flexible carrier sheet having a multiplicity of spaced-apart generally squat tubular columns on one face thereof extending generally at right angles to the sheet, said columns and carrier sheet being integrally molded of a substantially resilient synthetic resin material with each column being constituted by an integrally formed one-piece tubular member, and a layer of cushioning material on said one face of the carrier sheet occupying the spaces between said columns, the interiors of said columns being open and free of said cushioning material, said columns being so dimensioned and configured that, when subjected to an axial impact force of predetermined magnitude, the walls of the columns are adapted resiliently to buckle in irregular and random fashion for attenuating the shock resulting from said impact force, said columns then being adapted resiliently to return substantially to their undeformed shape; and means for fastening said pad means to the inside surface of the shell with said one face of said flexible sheet facing the shell and with said tubular columns generally at right angles to the shell.

9. Protective headgear as set forth in claim 8 wherein said layer of cushioning material has a thickness generally corresponding to the height of said columns.

10. Protective apparatus as set forth in claim 9 wherein said pad means comprises a plurality of separate pads.

11. Protective headgear as set forth in claim 8 wherein said columns are of a material having a Shore A durometer in the range of 50–90.

12. Protective headgear as set forth in claim 8 wherein the end faces of the columns are angle-cut, lying in planes which extend obliquely with respect to the central axes of the columns.

* * * * *